US007487048B2

(12) United States Patent
Morisaki et al.

(10) Patent No.: US 7,487,048 B2
(45) Date of Patent: Feb. 3, 2009

(54) CONVEYING APPARATUS, NOTIFICATION METHOD AND COMPUTER-READABLE MEDIUM FOR INDICATING A LEVEL OF MAINTENANCE REQUIRED

(75) Inventors: Hiroshi Morisaki, Nishikasugai-gun (JP); Kazuhiro Hayamizu, Nishikamo-gun (JP); Tetsuro Matsuno, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 453 days.

(21) Appl. No.: 11/128,194

(22) Filed: May 13, 2005

(65) Prior Publication Data

US 2005/0254842 A1 Nov. 17, 2005

(30) Foreign Application Priority Data

May 14, 2004 (JP) ..... 2004-145193

(51) Int. Cl.
*G03G 21/00* (2006.01)
*G06F 11/30* (2006.01)

(52) U.S. Cl. ..... 702/34; 702/187; 702/184; 399/9; 399/10; 399/11

(58) Field of Classification Search ..... 702/34, 702/187, 188
See application file for complete search history.

(56) References Cited

U.S. PATENT DOCUMENTS 4,707,715 A * 11/1987 Miura ..... 347/129
6,029,970 A * 2/2000 Hwang ..... 271/9.08
6,494,561 B1 * 12/2002 Yoshino ..... 347/23
6,786,481 B2 9/2004 Kawai et al.
7,003,258 B2 * 2/2006 Adachi et al. ..... 399/395
2003/0038419 A1 * 2/2003 Kawai et al. ..... 271/18

FOREIGN PATENT DOCUMENTS

| | | |
|---|---|---|
| JP | 03-219265 | 9/1991 |
| JP | 04 116045 | 4/1992 |
| JP | 04-308864 | 10/1992 |
| JP | 05-286601 | 11/1993 |

(Continued)

OTHER PUBLICATIONS

Translation of JP 03-219265.*

(Continued)

*Primary Examiner*—Hal D Wachsman
(74) *Attorney, Agent, or Firm*—Banner & Witcoff, Ltd.

(57) ABSTRACT

A technique is proposed to provide an appropriate notification in accordance with the state of occurrence of conveyance errors. The level of maintenance required to normalize a conveying function is determined depending on the number of errors, and a notification is provided by displaying a message to a user or by transmitting a message to a service center depending on the level of maintenance. Since the message to the user indicates a specific content of maintenance to normalize the conveying function, the user can normalize the conveying function by taking appropriate measures. On the other hand, since the message to the service center indicates the required level of maintenance, a service person of the service center can normalize the conveying function by going to a place where a multi-function machine, for example, is installed and repairing the multi-function machine.

22 Claims, 8 Drawing Sheets

FOREIGN PATENT DOCUMENTS

| | | |
|---|---|---|
| JP | 06-080277 | 3/1994 |
| JP | 6-80277 | 3/1994 |
| JP | 11-106092 | 4/1999 |
| JP | 2001-34126 | 2/2001 |
| JP | 2002-332141 | 11/2002 |
| JP | 2003-63670 | 3/2003 |

OTHER PUBLICATIONS

Translation of JP 06-080277.*

Translation of JP 05-286601.*

Translation of JP 04-308864.*

Translation of JP 04-116045.*

Family Search List for JP 2003-063670, provided by esp@cenet Feb. 3, 2005.

European Search Report for Application No. 05252937, dated Aug. 30, 2005.

* cited by examiner

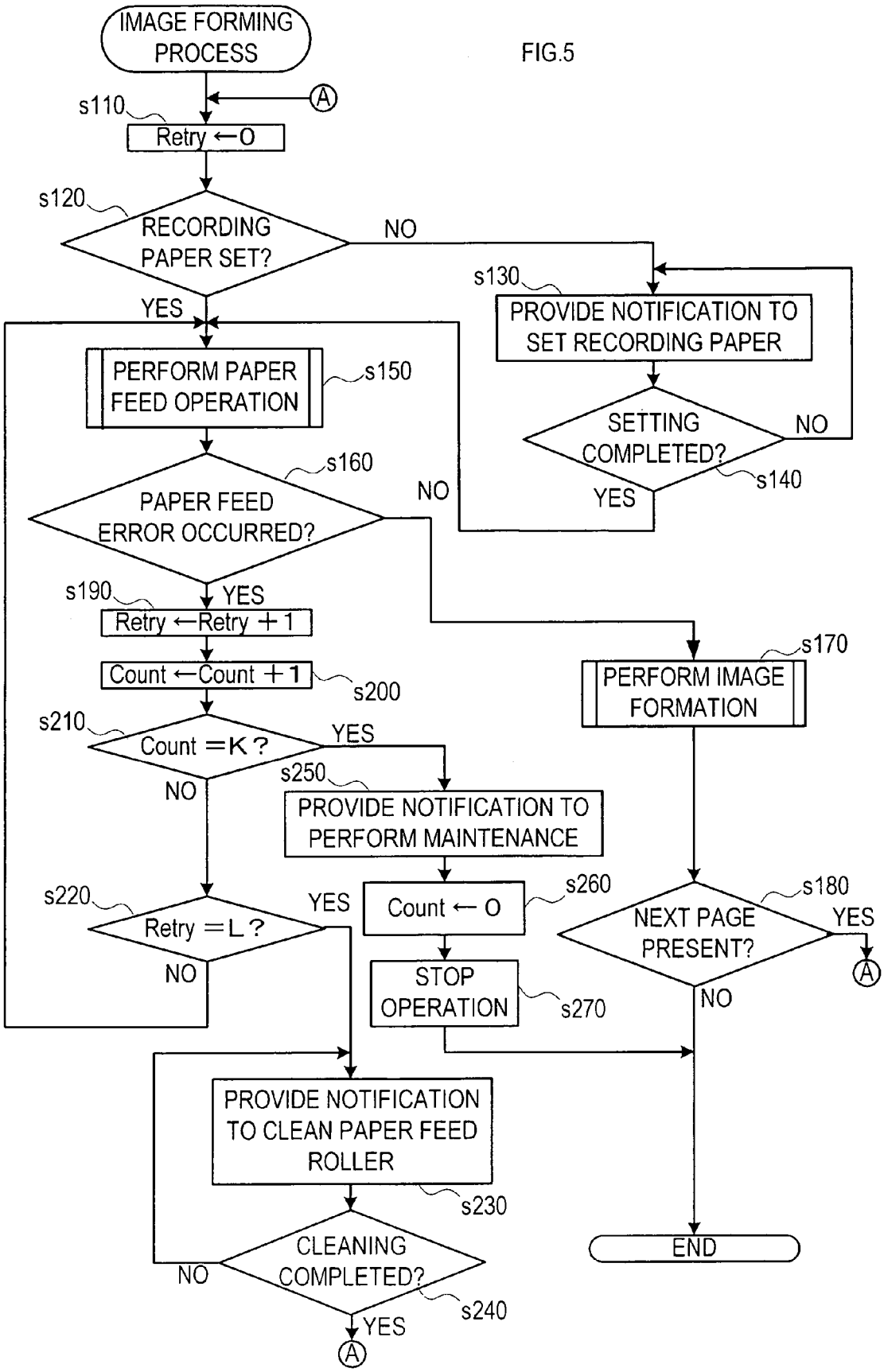
IMAGE FORMING PROCESS
FIG.5
A
s110
Retry ←0
s120
RECORDING PAPER SET?
NO
YES
s130
PROVIDE NOTIFICATION TO SET RECORDING PAPER
SETTING COMPLETED?
NO
YES
s140
PERFORM PAPER FEED OPERATION
s150
s160
PAPER FEED ERROR OCCURRED?
NO
YES
s190
Retry ←Retry +1
Count ←Count +1
s200
s170
PERFORM IMAGE FORMATION
s210
Count =K?
YES
NO
s250
PROVIDE NOTIFICATION TO PERFORM MAINTENANCE
s220
Retry =L?
YES
NO
Count ← 0
s260
STOP OPERATION
s270
s180
NEXT PAGE PRESENT?
YES
NO
A
PROVIDE NOTIFICATION TO CLEAN PAPER FEED ROLLER
s230
CLEANING COMPLETED?
NO
YES
s240
A
END

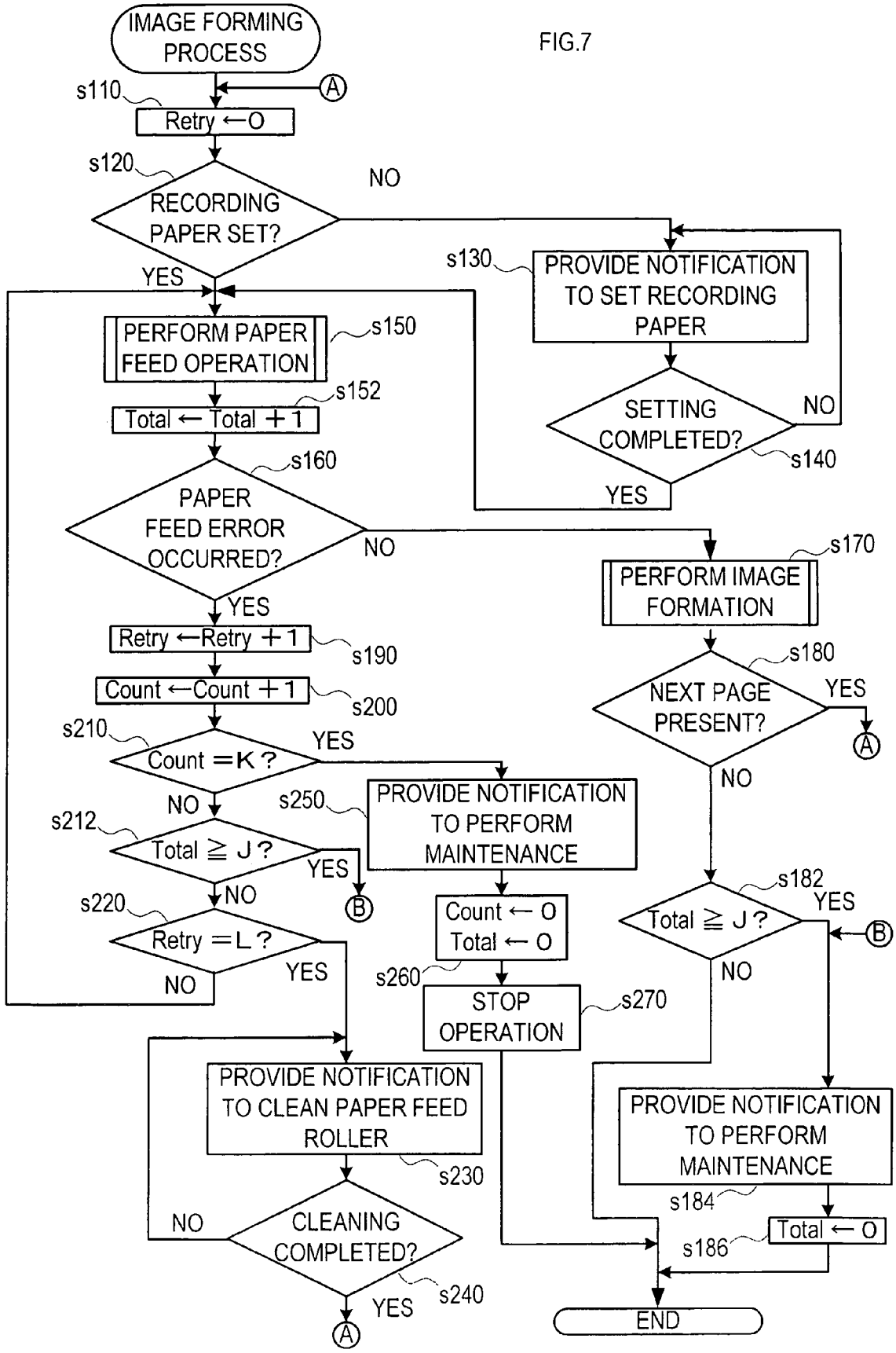
FIG.7
IMAGE FORMING PROCESS
A
s110
Retry ←0
s120
RECORDING PAPER SET?
NO
YES
s130
PROVIDE NOTIFICATION TO SET RECORDING PAPER
SETTING COMPLETED?
NO
s140
YES
PERFORM PAPER FEED OPERATION
s150
s152
Total ← Total + 1
s160
PAPER FEED ERROR OCCURRED?
NO
YES
s170
PERFORM IMAGE FORMATION
Retry ←Retry + 1
s190
Count ←Count + 1
s200
s180
NEXT PAGE PRESENT?
YES
A
NO
s210
Count = K ?
YES
NO
s250
PROVIDE NOTIFICATION TO PERFORM MAINTENANCE
s212
Total ≧ J ?
YES
B
NO
s220
Retry = L ?
YES
NO
Count ← 0
Total ← 0
s260
STOP OPERATION
s270
s182
Total ≧ J ?
YES
B
NO
PROVIDE NOTIFICATION TO CLEAN PAPER FEED ROLLER
s230
PROVIDE NOTIFICATION TO PERFORM MAINTENANCE
s184
NO
CLEANING COMPLETED?
s240
YES
A
Total ← 0
s186
END

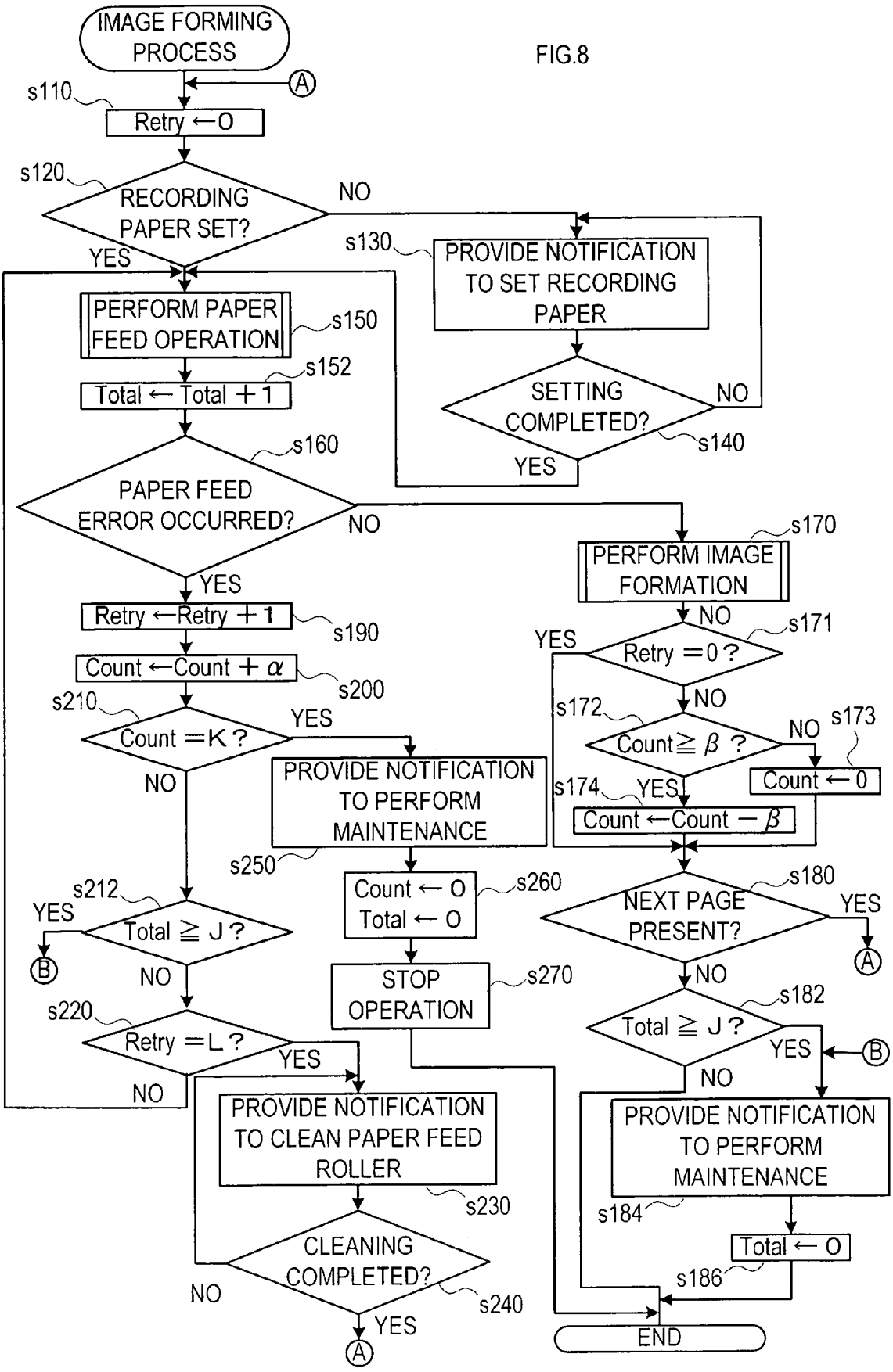
IMAGE FORMING PROCESS
FIG.8
A
s110
Retry ←0
s120
RECORDING PAPER SET?
NO
YES
s130
PROVIDE NOTIFICATION TO SET RECORDING PAPER
PERFORM PAPER FEED OPERATION
s150
s152
Total ← Total + 1
SETTING COMPLETED?
NO
s140
YES
s160
PAPER FEED ERROR OCCURRED?
NO
YES
s170
PERFORM IMAGE FORMATION
Retry ←Retry + 1
s190
NO
s171
YES
Retry =0 ?
Count ←Count + α
s200
s210
Count =K ?
YES
NO
s172
Count≧ β ?
NO
s173
Count ← 0
PROVIDE NOTIFICATION TO PERFORM MAINTENANCE
s174
YES
Count ←Count − β
s250
Count ← 0
Total ← 0
s260
s180
NEXT PAGE PRESENT?
YES
s212
YES
Total ≧ J ?
B
NO
STOP OPERATION
s270
NO
s182
s220
Retry =L ?
Total ≧ J ?
YES
YES
B
NO
NO
PROVIDE NOTIFICATION TO CLEAN PAPER FEED ROLLER
PROVIDE NOTIFICATION TO PERFORM MAINTENANCE
s230
s184
CLEANING COMPLETED?
Total ← 0
s186
NO
s240
YES
A
END

CONVEYING APPARATUS, NOTIFICATION METHOD AND COMPUTER-READABLE MEDIUM FOR INDICATING A LEVEL OF MAINTENANCE REQUIRED

CROSS-REFERENCE TO RELATED APPLICATIONS

This application claims the benefit of Japanese Patent Application No. 2004-145193 filed May 14, 2004 in the Japanese Patent Office, the disclosure of which is incorporated herein by reference.

BACKGROUND

The present invention relates to a conveying apparatus for conveying a recording medium such as recording paper.

In a conventional printer provided therein with a conveying apparatus for conveying recording paper, when a maintenance for normalizing conveying function is necessary due to an occurrence of a conveyance error, for example, the following measures are generally taken: the occurrence of such trouble is notified to a user, and then the user performs maintenance for normalizing conveying function on his/her own, or the user requests a service person to perform maintenance.

An example of techniques to notify an occurrence of trouble to a user is a configuration proposed in the Publication of Unexamined Japanese Patent Application No. 2003-63670 (e.g., paragraph [0043]). According to the proposed configuration, it is determined that a conveyance error (a paper feed error) has occurred when a sequence of actions to be regarded as an error (a paper feed failure) has been repeated a predetermined times, and then an error message is indicated.

This technique enables the user to confirm an occurrence of conveyance error by the error message. However, the user cannot fully understand what measures should be taken to normalize the conveying function of the conveying apparatus since a notification indicating only the occurrence of conveyance error is provided to the user according to the above technique. The conveying function will not be normalized unless the user can fully understand what measures should be taken.

A technique to normalize the conveying function through appropriate measures is proposed in the Publication of Unexamined Japanese Patent Application No. 6-80277. According to the technique, if a conveyance error occurs (i.e., if the time period, from when a paper feed roller is turned on until a paper feed sensor is turned on, exceeds a predetermined time period), a notification is provided to a host (a personal computer 36) in a service center connected through a communication line (a telephone line).

By using such a technique, a service person of the service center who is familiar with the conveying apparatus may confirm an occurrence of a conveyance error and go to the place where the conveying apparatus is installed to perform appropriate maintenance. Then, the conveying function of the conveying apparatus can surely be normalized.

SUMMARY

However, according to the above described technique, in which a notification is provided to a host in a service center, notifications to the service center will be provided regardless of the level of maintenance required to normalize the conveying function. Then, a service person may be required unnecessarily frequently to go to the place where the conveying apparatus is installed.

For example, an accidental conveyance error may be caused due to changes in the environment, entry of a tiny dust particle, and others since the conveying apparatus comprises a multiple of mechanical components. Such a conveyance error may not require substantial maintenance such as replacing paper feed rollers, or may require only easy maintenance such as interior cleaning to sufficiently normalize the conveying function. In this case, providing a notification to the service center is unnecessary.

As described above, conventional techniques that only provide a uniform notification regardless of the state of conveyance error occurrences lead to a service person's visit even when such a visit is unnecessary. That is, an appropriate notification cannot be provided.

The present invention, which has been made in view of the above-described problem, has an object to provide a technique for providing an appropriate notification depending on the state of conveyance error occurrences.

In one aspect of the present invention made for attaining the above object, there is provided a conveying apparatus which comprises: a conveying mechanism that conveys a recording medium; and a controller that monitors a state of conveyance of the recording medium by the conveying mechanism, determines a maintenance level indicating a level of maintenance required to normalize a conveying function of the conveying mechanism for conveying the recording medium, and provides a notification that the conveying function should be normalized by providing maintenance at the determined maintenance level.

According to the conveying apparatus configured as above, a notification may be provided that the conveying function should be normalized by providing maintenance at an appropriate maintenance level in accordance with the state of conveyance of the recording medium.

For example, in the case of providing a notification by displaying an error message corresponding to the state of conveyance, a user may understand that the conveying function should be normalized (or recovered) by providing maintenance at the maintenance level specified in the error message. Then, the conveying function may be normalized through the appropriate measures by the user. In the case of providing a notification by transmitting an error message to a service center, the service center may specify the maintenance level in accordance with the content of the error message. Then, a service person can go to a place where the conveying apparatus is installed and repair the same only when a substantial maintenance is required. This will prevent the service person from going to the place unnecessarily frequently.

In another aspect of the present invention, there is provided a notification method comprising the steps of: monitoring a state of conveyance by a conveying mechanism that conveys a recording medium; determining a maintenance level indicating a level of maintenance required for normalizing a conveying function of the conveying mechanism for conveying the recording medium, in accordance with the monitored state of conveyance; providing a notification that the conveying function should be normalized by providing maintenance at the determined maintenance level.

In a further aspect of the present invention, there is provided a program that makes a computer system function as the above-described controller.

The program, which comprises an ordered sequence of instructions suitable for processing by a computer, may be provided to a computer system or a user who uses the computer system through a recording medium such as an FD, a CD-ROM and a memory card. When provided to a user, the program may be pre-installed in a hard disk or a memory of the computer system. The computer system to execute the program may be a computer system installed in a conveying apparatus, or may be a separate computer capable of data communication with the conveying apparatus.

BRIEF DESCRIPTION OF THE DRAWINGS

Preferred embodiments of the present invention will be described hereinafter with reference to the drawings, in which:

FIG. 5 is a flowchart showing the steps of an image forming process in a first embodiment;

FIG. 7 is a flowchart showing the steps of an image forming process in a third embodiment; and FIG. 8 is a flowchart showing the steps of an image forming process in a modified embodiment.

DETAILED DESCRIPTION OF THE PREFERRED EMBODIMENTS

Figure 1:
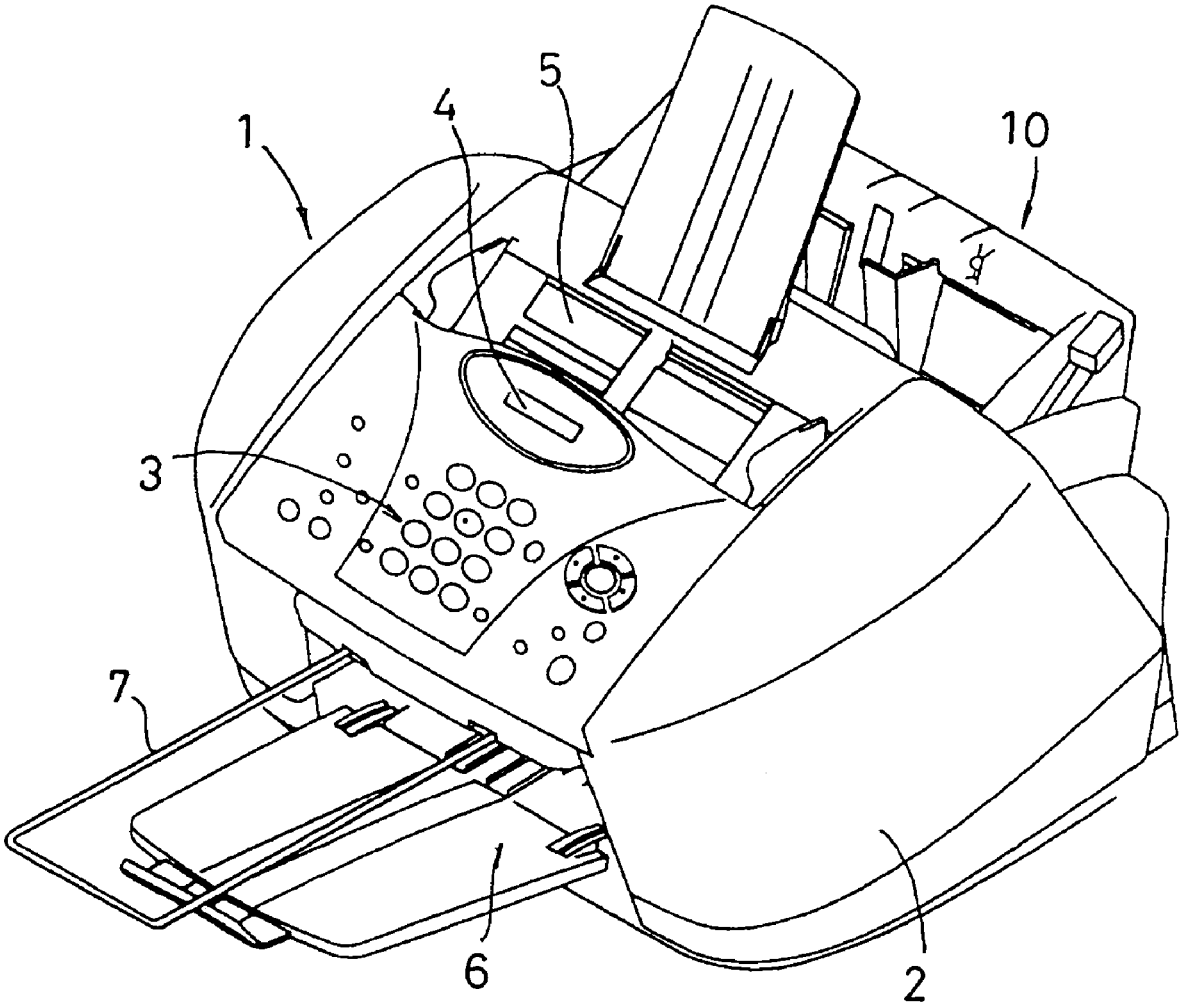
FIG. 1 is a perspective view showing a multi-function machine.

A multi-function machine 1 is an apparatus provided with a facsimile function, a printer function, a copier function, a scanner function, etc. As shown in FIG. 1, the multi-function machine 1 comprises a housing 2, an operation panel 3, a display portion 4, a document setting portion 5, a recording paper exit tray 6, an original document exit tray 7, and a paper feeder 10.

The operation panel 3 includes a variety of keys arranged on an upper surface of the housing 2. The display portion 4 includes a liquid crystal display disposed at the rear of the operation panel 3. The document setting portion 5 is disposed at the rear of the display portion 4. The recording paper exit tray 6 is disposed in front of the housing 2. The original document exit tray 7 is disposed over the recording paper exit tray 6. The paper feeder 10 is disposed at the rear of the document setting portion 5.

Figure 2:
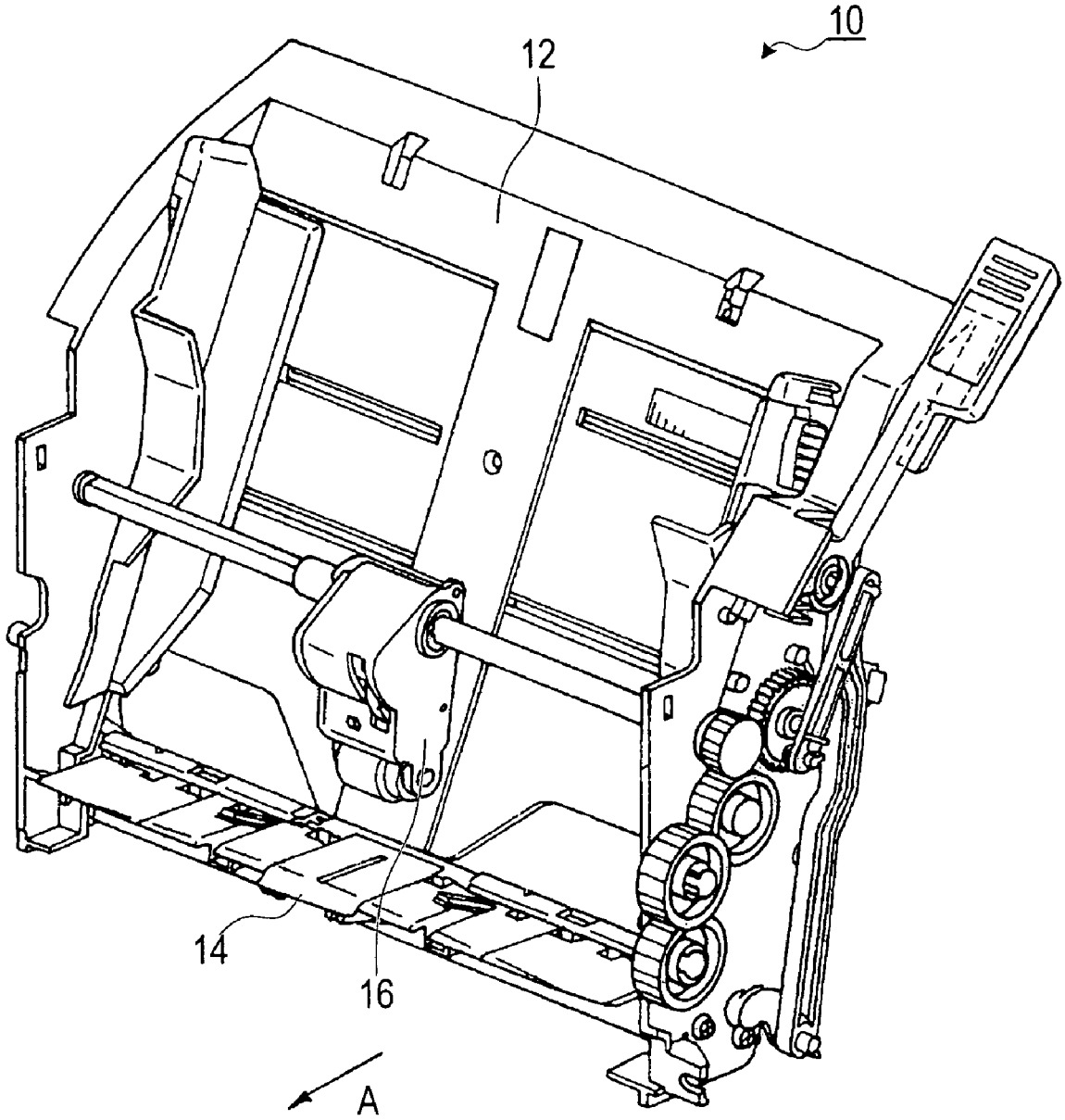
FIG. 2 is a perspective view showing a paper feeder.

As shown in FIG. 2, the paper feeder 10 comprises a storage portion 12, a medium holding portion 14, and a paper feed roller unit 16. The storage portion 12 stores sheets of recording paper. The medium holding portion 14 is located at a lower end of recording paper to be stored in the storage portion 12. The paper feed roller unit 16 conveys the recording paper stored in the storage portion 12 in a paper feeding direction (in the direction of an arrow A in FIG. 2). The recording paper is pulled out sheet by sheet from the storage portion 12 due to a friction between the lower end of the recording paper stored in the storage portion 12 and the medium holding portion 14.

Figure 3:
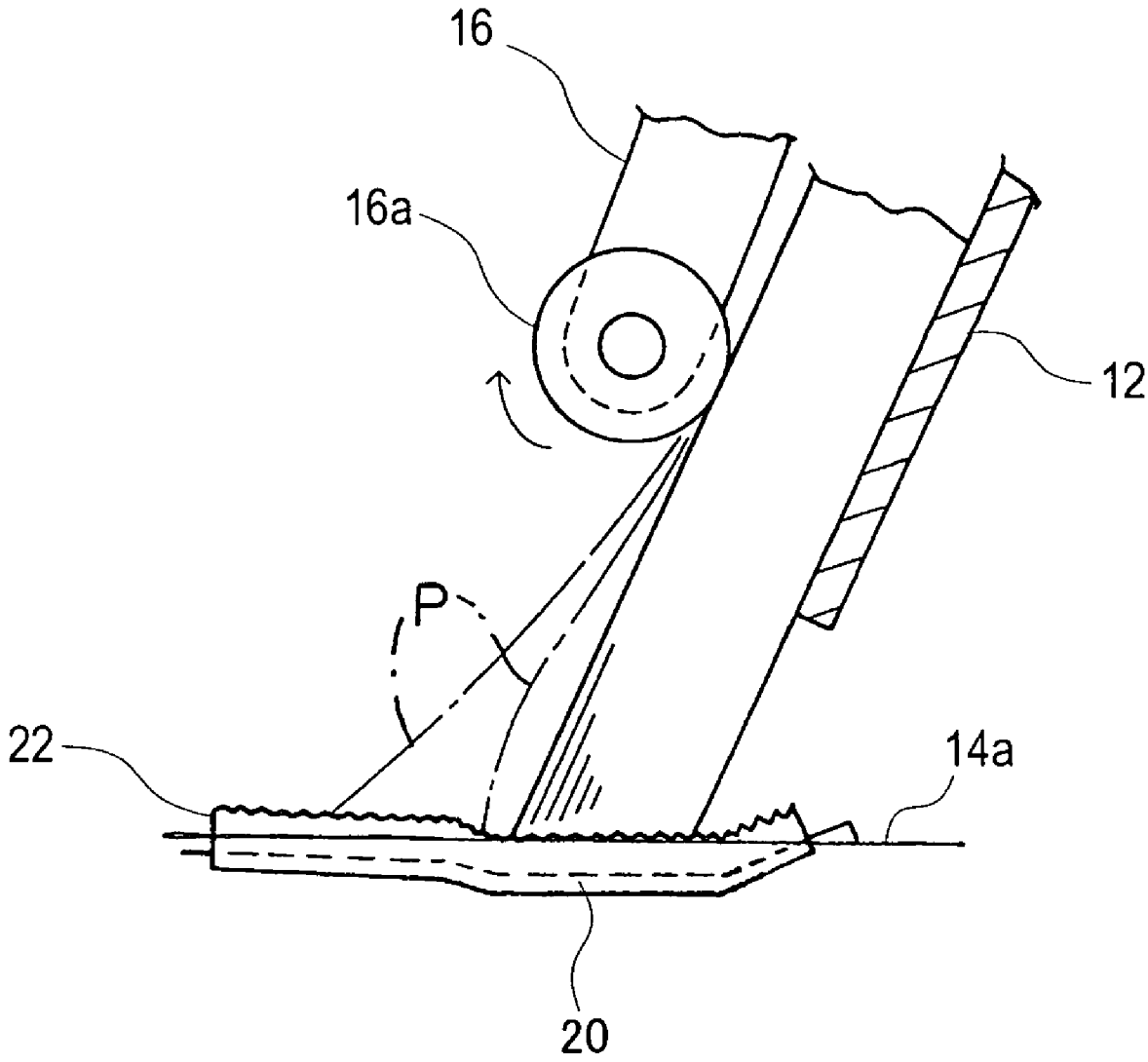
FIG. 3 is an explanatory view showing a manner of paper feeding by the paper feeder.

As shown in FIG. 3, a paper feed roller 16*a* in the paper feed roller unit 16 is rotated, and thereby an uppermost sheet of recording paper P set in the storage portion 12 is conveyed in a direction such that the recording paper P is pressed against the medium holding portion 14. Then, the recording paper P is gradually displaced in a conveying direction along a projection 22 of a projecting member 20, while pressing downward the projection 22 with the lower end of the recording paper P depending on the flexibility of the recording paper P. The recording paper P is displaced along the projection 22 until the lower end of the recording paper P contacts an upper surface 14*a* of the medium holding portion 14, and then the recording paper P is conveyed in a direction along the upper surface 14*a*, i.e., in a paper feed direction.

Figure 4:
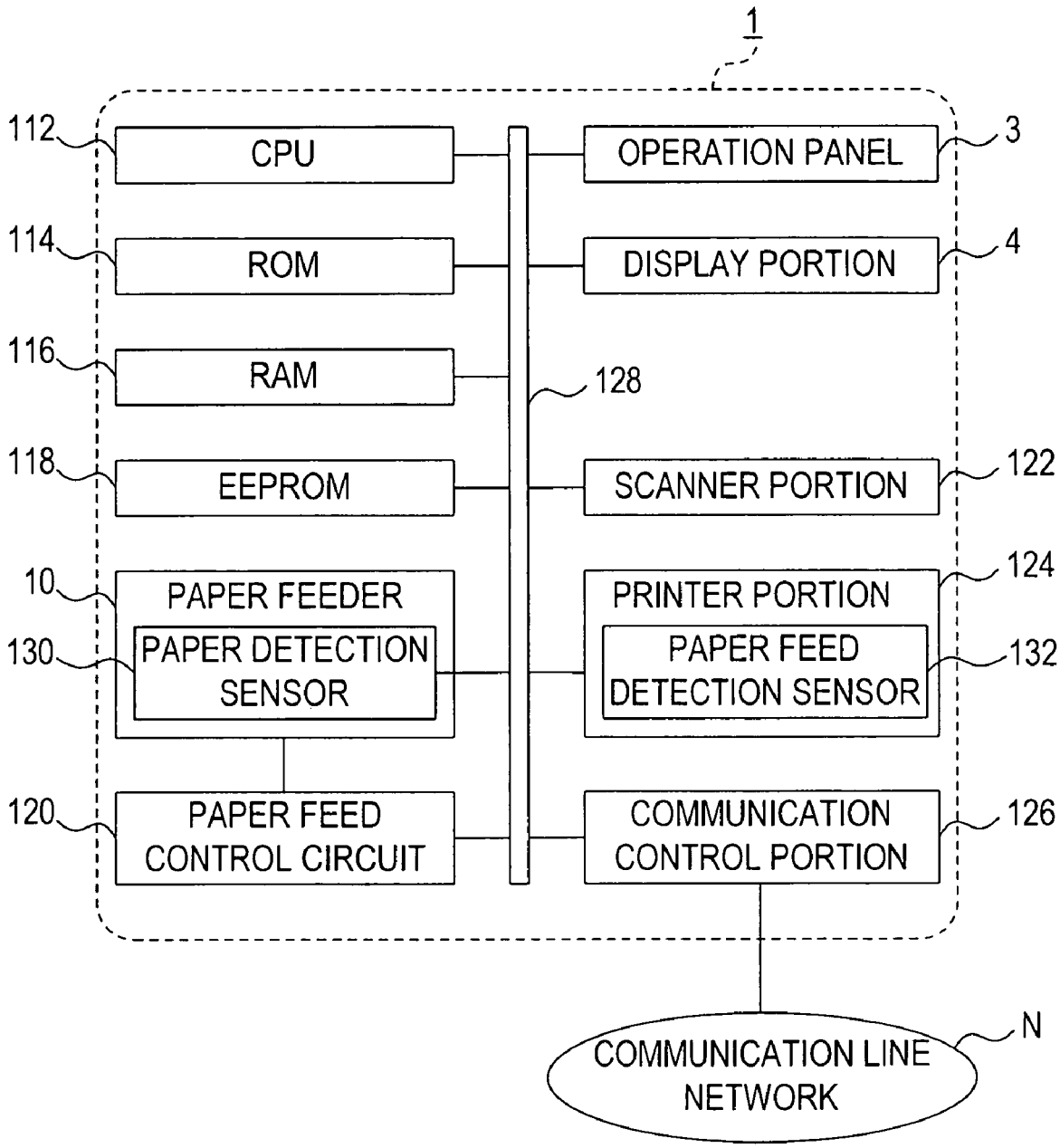
FIG. 4 is a block diagram showing a control system of the multi-function machine.

As shown in FIG. 4, the multi-function machine 1 constitutes a control system by connecting, through a bus 128, a CPU 112, a ROM 114, a RAM 116, an EEPROM (Electrically Erasable Programmable Read-Only Memory) 118, a paper feed control circuit 120, a scanner portion 122, a printer portion 124, a communication control portion 126, a paper detection sensor 180, and a paper feed detection sensor 132.

The CPU 112 controls the entire operation of the multi-function machine 1. The ROM 114 stores process steps executed by the CPU 112. The RAM 116 stores process results by the CPU 112. The EEPROM 118 stores setting details with respect to the variety of functions. The paper feed control circuit 120 controls the operation of the paper feeder 10. The scanner portion 122 reads an image from a document. The printer portion 124 forms an image on the recording paper. The communication control portion 126 connects the multi-function machine 1 to a communication line network N.

A plurality of embodiments including different process steps will now be described one by one. It is to be understood that the present invention should not be limited to the below described embodiments, but may be embodied in various forms which fall within the technical scope of the present invention.

First Embodiment

Operation of the CPU 112 for an image forming process, including a process making the paper feeder 10 feed paper, will be described below with reference to FIG. 5.

First, a parameter "Retry" is reset (Retry←0) (s110). The parameter "Retry" is stored in a specified area in the RAM 116 as a parameter for counting a number of continuous occurrences of paper feed errors (i.e., a number of continuous errors) in the paper feeder 10.

Then, it is checked whether or not the recording paper is set in the paper feeder 10 (s120). Specifically, it is determined whether or not the recording paper is set in the paper feeder 10 based on a detection result received from the paper detection sensor 130 (see FIG. 4) provided in the paper feeder 10. A mechanism to determine the presence or absence of the recording paper by the paper detection sensor 130, which is well-known, will not be described herein in detail.

When it is determined in s120 that the recording paper is not set (s120 NO), a notification to set the recording paper in the paper feeder 10 is provided (s130). The processing in s130 will be repeatedly performed until an operation indicating completion of setting of the recording paper is performed with the operation panel 3 (s140: NO). In s130, the notification is provided by displaying a message "Set Paper" indicating that paper supply is necessary in the display portion 4.

When an operation indicating completion of setting of the recording paper is performed (s140: YES) or when it is determined in s120 that the recording paper is set (s120: YES), paper feed operation of the paper feeder 10 is performed through the paper feed control circuit 120 (s150). Specifically, an uppermost sheet of the recording paper set in the storage portion 12 is conveyed in the paper feed direction by the paper feed roller unit 16 of the paper feeder 10 (see FIG. 3).

Subsequently, it is checked whether or not a paper feed error has occurred (s160). If conveyance of the recording paper is not detected by the paper feed detection sensor 132 (see FIG. 4) provided in the printer portion 124 within a predetermined time since the paper feed operation by the paper feeder 10 is started in s150, it is assumed that the recording paper has not been conveyed normally to the printer portion 124. Therefore, in s160, if a detection by the paper feed detection sensor 132 is not made within the above predetermined time, it is determined that a paper feed error has occurred. A mechanism to detect the conveyance of the recording paper by the paper feed detection sensor 132, which is well-known, will not be described herein in detail.

When it is determined in s160 that a paper feed error has not occurred (s160: NO), image formation on the recording paper which has been conveyed to the printer portion 124 is performed by the printer portion 124 (s170). The recording paper, on which image formation has been performed by the printer portion 124, is further conveyed to the recording paper exit tray 6.

Subsequently, when there is an image to be formed for the next page (s180: YES), the process step returns to s110, and image formation for the next page is performed in the same manner. When there is no image to be formed for the next page (s180: NO), the present image forming process is terminated.

When it is determined in s160 that a paper feed error has occurred (s160: YES), the parameter "Retry" is incremented by 1 (Retry←Retry+1) (s190), and also a parameter "Count" is incremented by 1 (Count←Count+1) (s200). The parameter "Count" is a parameter for counting a number of occurrences of paper feed errors (an accumulated number of errors) in the paper feeder 10. The parameter "Count" stored in a specified storage area in the EEPROM 118 is set at "0" in an initial setting (i.e., a factory default setting).

Then, it is checked whether or not the parameter "Count" has reached a predetermined threshold K (30 in the present embodiment) (Count=K?) (s210).

When it is determined in s210 that the parameter "Count" has not reached the predetermined threshold K (s210: NO), it is checked whether or not the parameter "Retry" has reached a "maximum retry number L (3 in the present embodiment)" (Retry=L?) (s220).

When it is determined in s220 that the parameter "Retry" has not reached the maximum retry number L (s220: NO), the process step returns to s150, and paper feed operation is performed again.

When it is determined that the parameter "Retry" has reached the maximum retry number L (s220: YES), a notification to clean the paper feed roller unit 16 (the paper feed roller 16*a*) in the paper feeder 10 is provided (s230). Specifically, in s230, a notification is provided by displaying a message "Clean Paper Feed Roller" indicating that cleaning of the paper feed roller unit 16 is necessary in the display portion 4.

In the present embodiment, as described above, in the case where the accumulated number of occurrences of paper feed errors (the parameter "Count") is small (i.e., the parameter "Count" has not reached the threshold K) and the number of occurrences of continuous paper feed errors (the parameter "Retry") has reached the maximum retry number L, it is determined that normalization (recovery) of the conveying function to convey the recording paper is possible by providing maintenance at a level (a maintenance level) of cleaning the paper feed roller unit 16. Therefore, a notification to clean the paper feed roller unit 16 is provided in s230.

After such a notification is provided, the processing in s230 is repeatedly performed until an operation indicating completion of cleaning of the paper feed roller unit 16 is performed with the operation panel 3 (s240: NO). When the operation is performed (s240: YES), the process step returns to s110, and then the present image forming process is started again from the beginning.

When it is determined in s210 that the parameter "Count" has reached the predetermined threshold K (s210; YES), a notification to perform maintenance of the paper feeder 10 is provided (s250). Specifically, the notification is provided, by automatically transmitting a message indicating that maintenance of the paper feeder 10 is necessary, to a host computer of a service center. The message includes product numbers (or lot numbers) of the multi-function machine 1 and the paper feeder 10, the value of the parameter "Count", the value of the parameter "Retry". Based on such information, the service center can specify the maintenance level required for normalizing the conveying function of the multi-function machine 1. Also, the service center can statistically specify a product number (or a lot number) with frequent occurrences of paper feed errors and take appropriate measures in the future.

When the parameter "Count" is reset (Count←0) (s260), and the operation of the paper feeder 10 is stopped (s270), the present image forming process is terminated.

In the present embodiment, as described above, in the case where the accumulated number of occurrences of paper feed errors (the parameter "Count") is increased (i.e., the parameter "Count" has reached the threshold K), it is determined that normalization of the conveying function is impossible without performing major maintenance such as replacing the paper feed roller unit 16. Then, a message indicating that maintenance of the paper feeder 10 is necessary, is transmitted to the host computer of the service center.

[Advantages of First Embodiment]

According to the paper feeder 10 of the multi-function machine 1 configured as above, the level of maintenance (the maintenance level) required for normalizing the conveying function is determined in s210 and s220 in FIG. 5. Depending on the maintenance level determined, a notification is provided by displaying a message to the user or by transmitting a message to the service center. Therefore, an appropriate notification may be performed in accordance with the state of conveyance of the recording paper determined in s210 and s220.

In the case of providing a message to the user in s230 in FIG. 5, for example, the message may have the user to understand that the conveying function should be normalized by the maintenance specified in the message. Accordingly, the conveying function may be normalized through the appropriate measures by the user. In the case of transmitting a message to the service center in s250 in FIG. 5, in contrast, the service center may specify the maintenance level in accordance with the content of the message. Therefore, a service person may go to the place where the multi-function machine 1 is installed and repair the same to normalize the conveying function.

In the image forming process in FIG. 5, the maintenance level is determined depending on the number of occurrences of paper feed errors (the accumulated number of errors or the number of continuous errors) in s210 or s220. Then, a notification indicating that the conveying function should be normalized by performing maintenance at the determined maintenance level may be provided in the processing in s230 or s250.

In the image forming process in FIG. 5, the maintenance level is determined depending on the accumulated number of errors in s210. The accumulated number of errors is the accumulated number of occurrences of paper feed errors until a point in time. The paper feeder 10 may be regarded as more deteriorated as the accumulated number of errors is increased.

It is, therefore, possible to monitor the deterioration of the paper feeder 10 from a long-term viewpoint based on the accumulated number of errors.

Also, in the image forming process in FIG. 5, the maintenance level is determined depending on the number of continuous errors in the processing in s220. When only the number of continuous errors is increased, it may be regarded that errors in conveyance have occurred continuously in a short time period due to a factor other than the deterioration of the paper feeder 10, such as changes in the environment around the multi-function machine 1 and entry of dust into the inside. It is, therefore, possible to monitor whether or not maintenance becomes necessary due to a factor other than the deterioration of the paper feeder 10 from a short-term viewpoint by checking the number of continuous errors in s220.

When it is determined in s220 that the parameter "Retry" has not reached the threshold L, the process step returns to s150, and paper feed operation is performed again. Accordingly, until the parameter "Retry" has reached the threshold L, paper feed operation can be repeatedly retried each time a paper feed error occurs.

Figure 6:
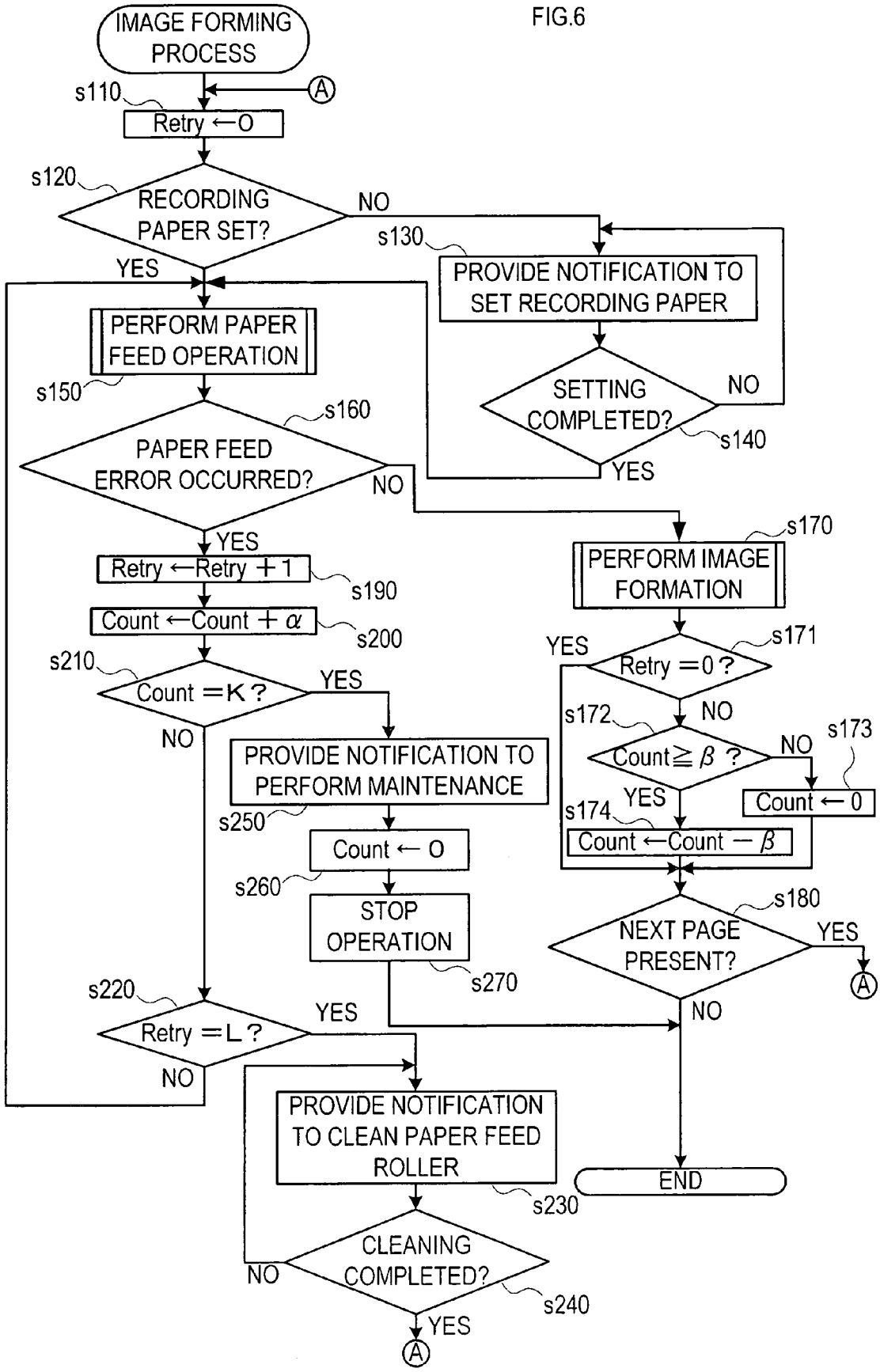
FIG. 6 is a flowchart showing the steps of an image forming process in a second embodiment.

In the image forming process in FIG. 6, a message indicating that maintenance of the paper feeder 10 is necessary, is transmitted to the service center in the processing in s250, only when the accumulated number of errors is increased, i.e., only when substantial maintenance is required to normalize the conveying function. Therefore, a service person can go to the place where the multi-function machine 1 is installed to repair the same only when major maintenance is necessary. This may prevent the service person from going to the place unnecessarily frequently.

In the image forming process in FIG. 5, the operation of the paper feeder 10 is stopped in s270 when the accumulated number of errors is increased. Since the fact that the accumulated number of errors is increased means that major maintenance is required to normalize the conveying function, continuation of the operation of the paper feeder 10 may cause abnormal operation of the paper feeder 10. It is, therefore, preferable to stop the operation of the paper feeder 10 in order to prevent abnormal operation of the paper feeder 10 as in the present embodiment.

The message transmitted in s250 in FIG. 5 includes the product numbers of the multi-function machine 1 and the paper feeder 10, the value of the parameter "Count", the value of the parameter "Retry". Accordingly, the service center can be notified that maintenance is required to normalize the conveying function. Additionally, the service center can specify the multi-function machine 1 and the paper feeder 10 as well as the state of use based on the information included in the message. Thus, the service center can perform further appropriate maintenance. Furthermore, the service center can statistically specify a product number (or a lot number) with frequent occurrence of paper feed errors, and take appropriate measures in the future.

Second Embodiment

Since a multi-function machine 1 in the present embodiment is different from the multi-function machine l in the first embodiment only in part of the image forming process, only differences between the embodiments will be described below.

In the image forming process of the present embodiment, as shown in FIG. 6, a predetermined additional value $\alpha$ is added to the parameter "Count" in s200 (Count←Count+$\alpha$). The additional value $\alpha$, which is "2" in the present embodiment, is preferably larger than "1".

After image formation is performed by the printer portion 124 in s170, it is checked whether or not the parameter "Retry" is "0" (s171).

When it is determined that the parameter "Retry" is not "0" (s171: NO), it is checked whether or not the parameter "Count" is equal to or more than an after-mentioned predetermined subtractive value $\beta$ ("1" in the present embodiment) (s172).

If it is determined that the parameter "Count" is equal to or more than the predetermined subtractive value $\beta$ (s172: YES), the predetermined subtractive value $\beta$ is subtracted from the parameter "Count" (Count←Count−$\beta$) (s174), and then the processing in s180 is performed.

If it is determined that the parameter "Count" is not equal to or more than the predetermined subtractive value $\beta$ (s172: NO), the parameter "Count" is set at "0" (Count←0) (s173), and then the processing in s180 is performed. The subtractive value $\beta$, which is "1" in the present embodiment, may be a value other than "1" as long as the subtractive value $\beta$ is smaller than the above-mentioned additional value $\alpha$.

When it is determined that the parameter "Retry" is "0" (s171: YES), the processing in s180 is performed without performing subtraction from the parameter "Count". In the present embodiment, as described above, the subtractive value $\beta$ is subtracted from the parameter "Count", only when it is determined in s171 that the parameter "Retry" is not "0", i.e., only when a paper feed error has occurred during the present image forming process.

[Advantages of Second Embodiment]

According to the paper feeder 10 of the multi-function machine 1 configured as above, the following advantages may be accomplished in addition to the advantages in the first embodiment.

In the paper feeder 10, the accumulated number of errors (the value of the parameter "Count") is increased in s200 in FIG. 6 each time a paper feed error occurs, while the accumulated number of errors is reduced in s174 each time paper feeding is performed normally. Accordingly, even when the accumulated number of errors is increased due to accidental paper feed errors, the effect of accidental conveyance errors, that is, an increase in the accumulated number of errors due to the accidental paper feed errors, may be offset if paper feeding is performed normally several times afterwards.

The additional value $\alpha$ to be added to the parameter "Count" in S200 in FIG. 6 is larger ($\alpha$=2) than the additional value "1" in the first embodiment. Then, the value of the parameter "Count" reaches the threshold K at an earlier timing compared with the first embodiment if paper feed errors occur in the same manner. Accordingly, when the accumulated number of errors is increased due to a substantial fault in the paper feeder 10, a notification to the service center may be provided in s250 in the present embodiment earlier than in the first embodiment. This advantage is more remarkable as the additional value $\alpha$ is larger.

Third Embodiment

Since a multi-function machine 1 in the present embodiment is different from the multi-function machine 1 in the first embodiment only in part of the image forming process, only differences between the embodiments will be described below.

In the image forming process of the present embodiment, as shown in FIG. 7, a parameter "Total" is incremented by 1 after the processing in s150 (s152), and then the processing in s160 is performed. The parameter "Total" is stored in a specified storage area in the EEPROM 118 as a parameter for counting a total number of paper feedings performed by the paper feeder 10. The parameter "Total" is set at "0" in an initial setting (i.e., a factory default setting).

When it is determined "NO" in s210, it is checked whether or not the parameter "Total" is equal to or more than a predetermined threshold J (100,000 in the present embodiment) (Total≧J?) (s212).

The threshold J is predetermined, for example, as a value indicating a number of the recording paper to be conveyed normally by the paper feed roller unit 16. Specifically, the threshold J is predetermined as a value indicating a number of conveyances of the recording paper, which may indicate an appropriate timing for performing maintenance, such as replacing components to be worn out due to a long-term use, e.g., parts of a paper feed roller or a motor for conveyance. The threshold J may be stored, for example, in a specified storage area in the RAM 116.

When it is determined that the parameter "Total" is not equal to or more than the predetermined threshold J (s212: NO), the process step proceeds to s220.

When it is determined that the parameter "Total" is equal to or more than the predetermined threshold J (s212: YES), a notification, indicating that maintenance of the paper feeder 10 is necessary, is provided (s184). The notification is provided by transmitting a message to the host computer of the service center in the same manner as in s250 in FIG. 5.

Subsequent to the processing in s184, the parameter "Total" is reset (Total←0) (s186), and the present image forming process is terminated. The fact that the parameter "Total" is equal to or more than the threshold J only means that the number of paper feedings is increased, but does not mean that paper feeding by the paper feeder 10 immediately becomes impossible. Therefore, when it is determined that the parameter "Total" is equal to or more than the threshold J in s212, the present image forming process is terminated without stopping the operation of the paper feeder 10.

When it is determined "NO" in s180, it is then checked whether or not the parameter "Total" is equal to or more than the threshold J in the same manner as in s212 (s182).

When it is determined that the parameter "Total" is not equal to or more than the predetermined threshold J (s182: NO), the present image forming process is terminated.

When it is determined that the parameter "Total" is equal to or more than the predetermined threshold J (s182: YES), the processing in s184 is performed.

In the present embodiment, it is determined that maintenance at a maintenance level, such as replacing worn out parts of the paper feed roller unit 16, is required to normalize (or recover) the conveying function for conveying recording paper, when the total number of paper feedings (i.e., the parameter "Total") is increased (i.e., has reached the threshold J). Then, a message, indicating that maintenance of the paper feeder 10 is necessary, is transmitted.

In s260, not only the parameter "Count", but also the parameter "Total" is reset (Count←0, Total←0).

[Advantages of Third Embodiment]

According to the paper feeder 10 of the multi-function machine 1 configured as above, the following advantages may be accomplished in addition to the advantages in the first embodiment.

In the paper feeder 10, when the parameter "Total" reaches or exceeds the threshold J, a notification may be provided in s184 to indicate that maintenance, such as replacing worn out parts, is required due to an increase in the total number of paper feedings. Since the notification is provided by transmitting a message to the host computer of the service center, the conveying function of the paper feeder 10 may be normalized by maintenance performed by a service person of the service center.

The present image forming process is terminated without stopping the operation of the paper feeder 10 when it is determined that the parameter "Total" is equal to or more than the threshold J in s212 in FIG. 7. The fact that the parameter "Total" is equal to or more than the threshold J only means that the number of paper feedings is increased. The fact does not mean that paper feeding by the paper feeder 10 immediately becomes impossible. To maintain the conveying function without stopping the operation of the paper feeder 10 in this case enables continuous paper feeding by the paper feeder 10, while allowing a user or a service person to perform maintenance at a convenient timing.

[Modification]

Although the present invention has been described with reference to the embodiments as above, the present invention should not be limited to the specific embodiments, but may be embodied in various forms which fall within the scope of the present invention.

For example, while the conveying apparatus of the present invention is applied to a paper feeder in the above embodiments, the conveying apparatus of the present invention may be applied to any apparatus used for conveying recording paper other than a paper feeder.

The maintenance level is determined based on the accumulated number of errors (the parameter "Count") and the number of continuous errors (the parameter "Retry") in the above embodiments. The maintenance level may be determined based on one of the accumulated number of errors and the number of continuous errors, or on another parameter indicating the state of conveyance of the paper feeder 10.

In the second embodiment, the additional value $\alpha$ to be added to the parameter "Count" in s200 in FIG. 6, is larger than the subtractive value $\beta$ to be subtracted from the parameter "Count" in s174 in FIG. 6. However, the additional value a may be smaller than the subtractive value $\beta$. In this case, for example, the additional value $\alpha$ may be "1", while the subtractive value $\beta$ may be "2".

According to the configuration as above, the accumulated number of errors is increased in s200 in FIG. 6 each time a paper feed error occurs. However, a subtractive value $\beta$ is subtracted from the accumulated number of errors in s174 in FIG. 6 when paper feeding is performed normally. Since the subtractive value $\beta$ is larger than the additional value $\alpha$, the accumulated number of errors will not be greatly increased unless paper feed errors occur continuously.

In other words, only when paper feeding by the paper feeder 10 (i.e., paper feed roller unit 16) cannot be performed normally and paper feed errors occur continuously, the accumulated number of errors will be greatly increased, and then the process step proceeds to the processing in s250. Therefore, subtracting the above-described large subtractive value $\beta$ from the accumulated number of errors may be suitable to detect whether substantial maintenance is necessary as in the case where conveyance by the paper feeder 10 cannot be performed normally.

In the above described embodiments, the thresholds (L, K, J) to be used in the image forming process may be stored in EEPROM 118. The thresholds may be changed to respective arbitrary values when an operation is performed in accordance with a specific procedure with the operation panel 3. Alternatively, the thresholds may be designed to be changed to respective arbitrary values in accordance with an instruction from the communication line network N (e.g., the service center). In this case, the user or the service center may arbitrarily change the thresholds to be used in the image forming process, Furthermore, as shown in FIG. 8, the image forming process of the above-described embodiments may include the steps of adding/subtracting the additional value α/the subtractive value β to/from the parameter "Count" in the second embodiment as well as the steps of checking the total number of paper feedings in the third embodiment.

In the above described embodiments, it is checked in s210 whether or not the parameter "Count" has reached the threshold K (Count=K?). However, it may be checked in s210 whether or not the parameter "Count" has reached or exceeded the predetermined threshold K (Count≧K?).

In the above described embodiments, it is checked in s220 whether or not the parameter "Retry" has reached the threshold J (Retry=L?). However, it may be checked in s220 whether or not the parameter "Retry" has reached or exceeded the threshold L (Count≧L?).

In the illustrated embodiments, a controller (including CPU 112, ROM 114, RAM 116 and EEPROM 118) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section, or a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

What is claimed is:

1. A conveying apparatus comprising:

a conveying mechanism that conveys a recording medium; and a controller that monitors a state of conveyance of the recording medium by the conveying mechanism, determines a maintenance level indicating a level of maintenance required to normalize a conveying function of the conveying mechanism for conveying the recording medium, and provides a notification that the conveying function should be normalized by providing maintenance at the determined maintenance level, wherein the controller further determines whether or not a conveyance of the recording medium by the conveying mechanism has been performed normally, counts a number of errors indicating a number of determinations that the conveyance has not been performed, and determines one maintenance level of different maintenance levels depending on the monitored number of errors, and wherein the controller counts an accumulated number of errors indicating an accumulated number of determinations that the conveyance has not been performed normally until a point in time, and determines that the maintenance level is a first error level when the monitored accumulated number of errors is smaller than a predetermined accumulated threshold, while determining that the maintenance level is a second error level requiring more major maintenance than in the first error level when the monitored accumulated number of errors reaches or exceeds the predetermined accumulated threshold.

2. The conveying apparatus according to claim 1, wherein the controller further counts a number of continuous errors indicating a number of continuous determinations that a conveyance has not been performed normally, and determines that the maintenance level is the first error level when the number of continuous errors reaches or exceeds a predetermined continuous threshold while the accumulated number of errors is smaller than the predetermined accumulated threshold, based on the monitored state of conveyance.

3. The conveying apparatus according to claim 2, wherein the controller makes the conveying mechanism repeatedly retry the conveyance each time it is determined by the controller that the conveyance has not been performed normally until the monitored number of continuous errors reaches or exceeds the predetermined continuous threshold.

4. The conveying apparatus according to claim 2, wherein when the maintenance level is determined as the first error level by the controller, the controller provides a message to a user indicating that the conveying function should be normalized by providing maintenance at the first error level.

5. The conveying apparatus according to claim 4, wherein the controller resets a count value of the number of continuous errors upon receiving from the user an operation indicating completion of maintenance after the message to a user, indicating that the conveying function should be normalized by providing maintenance at the first error level, is provided by the controller.

6. The conveying apparatus according to claim 2, wherein the controller arbitrarily changes at least one of the predetermined accumulated threshold and the predetermined continuous threshold in accordance with an instruction from outside of the conveying apparatus.

7. The conveying apparatus according to claim 1, wherein when the maintenance level is determined as the second error level by the controller, the controller transmits a message, indicating that the conveying function of the conveying apparatus should be normalized by providing maintenance at the second error level, to a host computer.

8. The conveying apparatus according to claim 7, wherein the controller resets a count value of the accumulated number of errors when the message, indicating that the conveying function of the conveying apparatus should be normalized by providing maintenance at the second error level, is transmitted by the controller.

9. The conveying apparatus according to claim 7, wherein the message transmitted to the host computer by the controller includes information about the conveying apparatus.

10. The conveying apparatus according to claim 9, wherein the message transmitted to the host computer by the controller includes information indicating a state of conveyance monitored by the controller.

11. The conveying apparatus according to claim 1, wherein when the maintenance level is determined as the second error level by the controller, the controller stops the operation of the conveying apparatus.

12. The conveying apparatus according to claim 1, wherein the controller counts the accumulated number of errors by adding a predetermined first value to the accumulated number of errors when it is determined by the controller that the conveyance has not been performed normally, while subtracting a predetermined second value smaller than the predetermined first value from the accumulated number of errors when it is determined by the controller that the conveyance has been performed normally.

13. The conveying apparatus according to claim 1, wherein the controller counts the accumulated number of errors by adding a predetermined first value to the accumulated number of errors when it is determined by the controller that the conveyance has not been performed normally, while subtracting a predetermined second value larger than the predetermined first value from the accumulated number of errors when it is determined by the controller that the conveyance has been performed normally.

14. The conveying apparatus according to claim 1, wherein the controller counts a total number of conveyances of the recording medium by the conveying mechanism, and determines that the maintenance level is at a worn out level requiring maintenance resulting from a state of use of the conveying apparatus when the monitored total number of conveyances reaches a predetermined conveyance threshold.

15. The conveying apparatus according to claim 14, wherein when the maintenance level is determined as the worn out level by the controller, the controller transmits a message, indicating that the conveying function of the conveying apparatus should be normalized by providing maintenance at the worn out level, to a host computer.

16. The conveying apparatus according to claim 15, wherein the controller resets a count value of the total number of conveyances when the message, indicating that the conveying function of the conveying apparatus should be normalized by providing maintenance at the worn out level, is transmitted by the controller.

17. The conveying apparatus according to claim 15, wherein the message transmitted to the host computer by the controller includes information about the conveying apparatus.

18. The conveying apparatus according to claim 17, wherein the message transmitted to the host computer by the controller includes information indicating a state of conveyance monitored by the controller.

19. The conveying apparatus according to claim 14, wherein when the maintenance level is determined as the worn out level by the controller, the conveying function is maintained.

20. The conveying apparatus according to claim 14, wherein the controller arbitrarily changes at least one of the predetermined accumulated threshold and the predetermined continuous threshold in accordance with an instruction from outside of the conveying apparatus.

21. A notification method comprising the steps of:

monitoring a state of conveyance by a conveying mechanism that conveys a recording medium;

determining a maintenance level indicating a level of maintenance required for normalizing a conveying function of the conveying mechanism for conveying the recording medium, in accordance with the monitored state of conveyance;

providing a notification that the conveying function should be normalized by providing maintenance at the determined maintenance level;

determining whether or not a conveyance of the recording medium by the conveying mechanism has been performed normally;

counting a number of errors indicating a number of determinations that the conveyance has not been performed;

determining one maintenance level of different maintenance levels depending on the monitored number of errors, counting an accumulated number of errors indicating an accumulated number of determinations that the conveyance has not been performed normally until a point in time;

determining that the maintenance level is a first error level when the monitored accumulated number of errors is smaller than a predetermined accumulated threshold, while determining that the maintenance level is a second error level requiring more major maintenance than in the first error level when the monitored accumulated number of errors reaches or exceeds the predetermined accumulated threshold.

22. A computer readable medium having computer-executable instructions stored thereon for a conveying apparatus including a conveying mechanism that conveys a recording medium, wherein the instructions when executed by a computer perform a method comprising the steps of:

monitoring a state of conveyance of the recording medium by the conveying mechanism;

determining a maintenance level indicating a level of maintenance required to normalize a conveying function of the conveying mechanism for conveying the recording medium;

providing a notification that the conveying function should be normalized by providing maintenance at the determined maintenance level;

determining whether or not a conveyance of the recording medium by the conveying mechanism has been performed normal;

counting a number of errors indicating a number of determinations that the conveyance has not been performed;

determining one maintenance level of different maintenance levels depending on the monitored number of errors;

counting an accumulated number of errors indicating an accumulated number of determinations that the conveyance has not been performed normally until a point in time; and determining that the maintenance level is a first error level when the monitored accumulated number of errors is smaller than a predetermined accumulated threshold, while determining that the maintenance level is a second error level requiring more major maintenance than in the first error level when the monitored accumulated number of errors reaches or exceeds the predetermined accumulated threshold.

* * * * *

UNITED STATES PATENT AND TRADEMARK OFFICE

CERTIFICATE OF CORRECTION

PATENT NO. : 7,487,048 B2
APPLICATION NO. : 11/128194
DATED : February 3, 2009
INVENTOR(S) : Hiroshi Morisaki et al.

It is certified that error appears in the above-identified patent and that said Letters Patent is hereby corrected as shown below:

In Column 14, Claim 22, Line 40:
Please replace "normal;" with --normally;--

Signed and Sealed this

Twenty-second Day of September, 2009

David J. Kappos

David J. Kappos
*Director of the United States Patent and Trademark Office*